US011480035B1

(12) United States Patent
Sanchez Torrealba et al.

(10) Patent No.: US 11,480,035 B1
(45) Date of Patent: Oct. 25, 2022

(54) PRESSURE ASSISTED OIL RECOVERY SYSTEM AND APPARATUS

(71) Applicants: Oswaldo Jose Sanchez Torrealba, Edo. Mirando (VE); Oswaldo Alejandro Sanchez Medina, Edo. Miranda (VE); Victor Raul Castillo, Estado Anzoátegui (VE)

(72) Inventors: Oswaldo Jose Sanchez Torrealba, Edo. Mirando (VE); Oswaldo Alejandro Sanchez Medina, Edo. Miranda (VE); Victor Raul Castillo, Estado Anzoátegui (VE)

( * ) Notice: Subject to any disclaimer, the term of this patent is extended or adjusted under 35 U.S.C. 154(b) by 136 days.

(21) Appl. No.: 17/012,323

(22) Filed: Sep. 4, 2020

(51) Int. Cl.

| | |
|---|---|
| ***E21B 43/16*** | (2006.01) |
| ***E21B 47/06*** | (2012.01) |
| ***E21B 28/00*** | (2006.01) |
| ***E21B 43/00*** | (2006.01) |
| ***E21B 49/08*** | (2006.01) |
| ***E21B 47/07*** | (2012.01) |
| ***E21B 34/00*** | (2006.01) |

(52) U.S. Cl.
CPC ..... *E21B 43/003* (2013.01); *E21B 34/00* (2013.01); *E21B 43/16* (2013.01); *E21B 47/06* (2013.01); *E21B 47/07* (2020.05); *E21B 49/0875* (2020.05)

(58) Field of Classification Search
CPC ..... E21B 43/003; E21B 34/00; E21B 43/16; E21B 47/06; E21B 28/00
See application file for complete search history.

(56) References Cited

U.S. PATENT DOCUMENTS

| | | | |
|---|---|---|---|
| 4,084,638 A | 4/1978 | Whiting | |
| 6,237,691 B1 | 5/2001 | Kelley et al. | |
| 6,443,229 B1 | 9/2002 | Kulka | |
| 6,747,569 B2 | 6/2004 | Hill et al. | |
| 6,854,518 B1 | 2/2005 | Senyard et al. | |
| 6,937,159 B2 | 8/2005 | Hill et al. | |
| 7,051,817 B2 | 5/2006 | Shaposhnikov et al. | |
| 7,373,976 B2 * | 5/2008 | Casey | E21B 47/053 166/250.03 |

(Continued)

FOREIGN PATENT DOCUMENTS

| | | |
|---|---|---|
| WO | 2014056949 A2 | 8/2015 |
| WO | 2016057780 A1 | 4/2016 |
| WO | 2017091688 A1 | 6/2017 |

*Primary Examiner* — Catherine Loikith
(74) *Attorney, Agent, or Firm* — Albert Bordas, P.A.

(57) ABSTRACT

A pressure assisted oil recovery system and apparatus that has a pulsating effect unit, a multiphasic flow meter, and a production lift system that passes through a wellbore up to an oil reservoir. The pulsating effect unit has a control valve and a smart control unit. The production lift system has production tubing and a wellhead. The pulsating effect unit is connected to the production lift system. The multiphasic flow meter is connected to the production tubing to obtain well production parameters data. The control valve opens and closes having an opening/closing predetermined frequency. When the control valve opens and closes, it generates pressure variations along the production tubing. The pressure variations create a pulsating effect on walls of the wellbore. The multiphasic flow meter and the pulsating effect unit set an optimal opening/closing frequency of the control valve.

18 Claims, 4 Drawing Sheets

(56) References Cited

U.S. PATENT DOCUMENTS

| | | | | |
|---|---|---|---|---|
| 7,448,447 | B2 * | 11/2008 | Walford | E21B 47/07 166/272.3 |
| 7,556,099 | B2 | 7/2009 | Arthur et al. | |
| 8,122,966 | B2 | 2/2012 | Kelley | |
| 8,459,368 | B2 | 6/2013 | Sivrikoz et al. | |
| 8,528,648 | B2 | 9/2013 | Zupanick | |
| 8,701,777 | B2 | 4/2014 | Gano et al. | |
| 8,833,488 | B2 | 9/2014 | Knudsen et al. | |
| 9,019,118 | B2 | 4/2015 | Milne et al. | |
| 9,031,823 | B2 | 5/2015 | Ranjan et al. | |
| 10,267,128 | B2 | 4/2019 | Parrella | |
| 10,443,364 | B2 | 10/2019 | Parrella et al. | |
| 10,451,190 | B2 | 10/2019 | Goehler et al. | |
| 2017/0247993 | A1 | 8/2017 | Perrella | |
| 2019/0218889 | A1 | 7/2019 | Cioanta et al. | |
| 2021/0301650 | A1 * | 9/2021 | Batarseh | G01N 29/348 |

* cited by examiner

PRESSURE ASSISTED OIL RECOVERY SYSTEM AND APPARATUS

BACKGROUND OF THE INVENTION

1. Field of the Invention

The present invention relates to oil extraction systems, and more particularly to pressure assisted oil recovery systems.

2. Description of the Related Art

Applicant believes that one of the closest references corresponds to U.S. Pat. No. 4,084,638 A issued to Whiting on Apr. 18, 1978 for Method of production stimulation and enhanced recovery of oil. However, it differs from the present invention because Whiting teaches a method of recovery of petroleum from presently existing wells, which are either non-producing or low production types. The method utilizes surges and oscillations of electrical energy in excess of 150 kilovolts involving the use of heavy current flow over a carbonaceous path in order to establish heat, electrical and physical shock, and steam fracturing (or shattering) within certain sedimentary rock formations, thereby giving rise to an increase in the effective well and reservoir radius both within an existing well and between wells. The method involves the use of a minimum of two existing wells, one being an injection well and the other being a production or recovery well. In each well, insulated high voltage cable is secured within the well casing in order to feed required electrical energy into a probe rod, which, at the bottom of each well is driven into the oil stratum in a configuration in which each probe is directed toward the other. The distance of the respective probes from each other will, depending upon factors of voltage, current flow and geological conditions, be disposed as close as 25 feet apart or, in any given instance, as far as 3,000 feet apart.

Applicant believes that another reference corresponds to U.S. Pat. No. 6,237,691 B1 issued to Kelley, et al. on May 29, 2001 for Method and apparatus for increasing fluid recovery from a subterranean formation. However, it differs from the present invention because Kelley, et al. teach a downhole injector at the lower end of the production tubing string for passing liquids from a downhole formation into the tubing string while preventing gases from passing through the injector. The injector may include an improved screen for preventing formation sand from entering the injector. The system may include a packer in the annulus above the injector. In one application, a vent tube extends upward from the packer into the annulus for maintaining a desired liquid level in the annulus above the packer. A plurality of through ports establish fluid communication in the annulus above the packer and the production tubing string, so that a downhole pump may efficiently pump downhole fluids to the surface. The injector may be used with one or more lift valves for raising slugs of liquid upward to the surface through the production tubing string.

Applicant believes that another reference corresponds to U.S. Pat. No. 6,443,229 B1 issued to Kulka on Sep. 3, 2002 for Method and system for extraction of liquid hydraulics from subterranean wells. However, it differs from the present invention because Kulka teaches a method and system for tertiary or enhanced oil recovery from a subterranean liquid hydrocarbon or oil wells. The method uses packers or angled wells in order to force the gas down into the oil bearing strata from a gas containing strata. The result is increased production of oil since the gas is forced downward over a large horizontal area between the gas containing strata and oil bearing strata.

Applicant believes that another reference corresponds to U.S. Pat. No. 6,747,569 B2 issued to Hill, et al. on Jun. 8, 2004 for Downhole telemetry and control system. However, it differs from the present invention because Hill, et al. teach a borehole that includes a casing and a piping structure therein and at least one downhole equipment module located therein. The system provides for the power signal that is used to provide power transfer to be modulated with data and control signals that are to be transmitted to the downhole equipment located in the downhole equipment modules. The system provides for the power/data signal to be electrically coupled to the case and piping structure for transmission downhole. The downhole equipment includes a power supply that is operative to recover the power signal portion of the power/data signal and to provide power to the other downhole equipment. A downhole receiver is operative to recover the dataportion of the power/data signal and to demodulate the data provided thereon. The system can further include a downhole data source coupled to a downhole transmitter for impressing the downhole data onto the case and piping structure for transmission uphole. A receiver contained in the surface equipment is operative to receive and recover the transmitted downhole data for analysis and storage by surface equipment.

Applicant believes that another reference corresponds to U.S. Pat. No. 6,854,518 B1 issued to Senyard, et al. on Feb. 15, 2005 for Method and apparatus for enhancing production from an oil and/or gas well. However, it differs from the present invention because Senyard, et al. teach a method of assisting production of an oil and/or gas well that involves reducing the pressure at the top of a well and aid in oil and gas production. If any gas exists in the produced fluid, gas expansion at the resulting reduced pressure will reduce the fluid density in the production pipe, thus further assisting fluid production. If some secondary production enhancement is in use (balance beam, downhole pump, gas lift, surfactant, etc.), this process will increase the efficiency of the secondary lift. If supplemental gas is introduced anywhere along the production pipe as a "gas lift" method of secondary production, this supplemental gas expansion at the resulting reduced pressure will reduce the fluid density in the production pipe, thus further assisting fluid production. If the pressure reducer is applied to the line pipe carrying the production fluids remote from the wellhead, the reduced pressure will enhance fluid velocity and amount, expanding gas in the fluid at lower pressures in the pipe will increase the flowing velocity of the fluid.

Applicant believes that another reference corresponds to U.S. Pat. No. 6,937,159 B2 issued to Hill, et al. on Aug. 30, 2005 for Downhole telemetry and control system using orthogonal frequency division multiplexing. However, it differs from the present invention because Hill, et al. teach a power transmission and data communications system for use in a gas or oil well borehole. The borehole includes a casing and a piping structure therein and at least one downhole equipment module located therein. The system provides for a power signal to provide power transfer to downhole systems that require power and for data and control signals to be transmitted using orthogonal frequency division multiplexing (OFDM) to the downhole equipment located in the downhole equipment modules. In particular, the system provides for the data signal to be electrically coupled to the case and piping structure for transmission downhole to the downhole systems that are similarly coupled to the casing and piping structure. The downhole equipment includes a power supply that is operative to recover electrical power from the power signal and to provide output power to the other downhole equipment. A downhole modem/receiver is operative to recover the data portion of the power/data signal and to demultiplex the OFDM signal and to demodulate the data provided thereon. The system can further include a downhole data source coupled to a downhole transmitter for impressing the downhole data onto the case and piping structure for transmission uphole. A receiver contained in the surface equipment is operative to receive and recover the transmitted downhole data for analysis and storage by surface equipment. In addition, relaying of signals can be provided for between the surface modem and two or more downhole modems. The relaying function of the middle downhole modem allows downhole modems to be communicated with than other wise possible. The middle downhole modem receives the communications message sent to a downhole modem further down the borehole and after a predetermined period will retransmit the message downhole.

Applicant believes that another reference corresponds to U.S. Pat. No. 7,051,817 B2 issued to Shaposhnikov, et al. on May 30, 2006 for Device for improving oil and gas recovery in wells. However, it differs from the present invention because Shaposhnikov, et al. teach a device for improving recovery of hydrocarbons through a well by creating, regulating and maintaining under the device a calculated bottomhole pressure at a desired level and creating above the device a two-phase gas-liquid homogenous flow for efficient lifting of hydrocarbons to a surface, the device has a body having a central through going opening with a shape corresponding a shape of a Laval nozzle and with a cross section which changes steplessly and gradually, and a mandrel attachable to a tubing and associated with the body without interfering with a flow of fluids.

Applicant believes that another reference corresponds to U.S. Pat. No. 7,556,099 B1 issued to Arthur, et al. on Jul. 7, 2009. for Recovery process. However, it differs from the present invention because Arthur, et al. teach a method for recovering hydrocarbons from a subterranean reservoir by operating a first injector-producer well pair under a substantially gravity controlled recovery process, the first injector-producer well pair forming a first mobilized zone, operating a second injector-producer well pair under a substantially gravity-controlled recovery process, the second injector-producer well pair forming a second mobilized zone, the first injector-producer well pair and the second injector-producer well pair together being the adjacent well pairs, providing an infill well in a bypassed region, the bypassed region formed between the adjacent well pairs when the first mobilized zone and the second mobilized zone merge to form a common mobilized zone, operating the infill well to establish fluid communication between the infill well and the common mobilized zone, operating the infill well and the adjacent well pairs under a substantially gravity-controlled recovery process, and recovering hydrocarbons from the infill well.

Applicant believes that another reference corresponds to U.S. Pat. No. 8,122,966 B2 issued to Kelley on Feb. 28, 2012 for Total in place hydrocarbon recovery by isolated liquid and gas production through expanded volumetric wellbore exposure. However, it differs from the present invention because Kelley teaches a higher volumetric hydrocarbon exposed original or restored by miscible gas injection, solution gas saturated oil is recovered through enlarged expandable liner, sand screened wellbores by controlled wellbore to formation pressure maintained above recovering oils critical bubble point. Exclusively hydrocarbon formation liquids are differential pressure forced through centralizer held larger outer diameter liquid displacer into the production tubing, while maintaining gas volume, pressure, and solution gas saturation in the formation, for higher volume flow for total in place oil recovery. Injected downstructure waterdrive pressure (WDP) into oil or gas formations augments oil and/or gas production and recovery. Complete gas well deliquefying is attained by flowing gas recovery through enlarged expandable liner and sand screened wellbores and up the wellbore annulus dry, while producing all liquids separately through the larger outer diameter liquid displacer into the production tubing, to be artificial lifted to surface, while waterdrive pressure (WDP) augments natural gas recovery.

Applicant believes that another reference corresponds to U.S. Pat. No. 8,459,368 B2 issued to Sivrikoz, et al. on Jun. 11, 2013 for Systems and methods for producing oil and/or gas. However, it differs from the present invention because Sivrikoz, et al. teach a system comprising a carbon disulfide formulation storage; a mechanism for releasing at least a portion of the carbon disulfide formulation into a formation; and a mechanism for creating a pulse in the carbon disulfide formulation in the formation. Pressure pulsing is a deliberate variation of the fluid pressure in the porous medium through the injection of fluid, withdrawal of fluid, or a combination of alternating periods of injection and withdrawal. The pressure pulsing may be regular or irregular (periodic or aperiodic), continuous or episodic, and may be applied at the point of injection, withdrawal, or at other points in the region of the porous medium affected by the flow process.

Applicant believes that another reference corresponds to U.S. Pat. No. 8,528,648 B2 issued to Zupanick on Sep. 10, 2013 for Flow control system for removing liquid from a well. However, it differs from the present invention because Zupanick teaches a flow control system that includes a pump positioned in a well to remove liquid from the well. A check valve is positioned in the well and includes an open position and a closed position. The check valve in the open position allows gas from a producing formation of the well to flow past the check valve, while the check valve in the closed position substantially reduces gas flow at the pump from the producing formation. A compressed gas source is in fluid communication with the well to provide compressed gas to move the check valve to the closed position.

Applicant believes that another reference corresponds to U.S. Pat. No. 8,701,777 B2 issued to Gano, et al. on Apr. 22, 2014 for Downhole fluid flow control system and method having dynamic response to local well conditions. However, it differs from the present invention because Gano, et al. teach a downhole fluid flow control system having dynamic response to local well conditions. The system includes a tubing string operably positionable in a wellbore. Annular barriers are positioned between the tubing string and the wellbore to isolate first and second zones. A fluid flow control device is positioned within each zone. A flow tube that is operably associated with the fluid flow control device of the first zone is operable to establish communication between the second zone and the fluid flow control device in the first zone such that a differential pressure between the first zone and the second zone is operable to actuate the fluid flow control device of the first zone from a first operating configuration to a second operating configuration.

Applicant believes that another reference corresponds to U.S. Pat. No. 8,833,488 B2 issued to Knudsen, et al. on Sep. 16, 2014 for Automatic standpipe pressure control in drilling. However, it differs from the present invention because Knudsen, et al. teaches a method of controlling standpipe pressure in a drilling operation that include comparing a measured standpipe pressure to a desired standpipe pressure, and automatically adjusting a choke in response to the comparing, thereby reducing a difference between the measured standpipe pressure and the desired standpipe pressure. A standpipe pressure control system for use in a drilling operation includes a controller, which outputs an annulus pressure setpoint based on a comparison of a measured standpipe pressure to a desired standpipe pressure, and a choke, which is automatically adjusted in response to the annulus pressure setpoint. A well system can include a standpipe line connected to a drill string in a wellbore, a sensor, which measures pressure in the standpipe line, and a controller, which outputs an annulus pressure setpoint based at least in part on a difference between the measured pressure and a desired standpipe pressure.

Applicant believes that another reference corresponds to U.S. Pat. No. 9,019,118 B2 issued to Milne, et al. on Apr. 28, 2015 for Automated well control method and apparatus. However, it differs from the present invention because Milne, et al. teach a drilling control system that monitor and compare drilling and completion operation sensor values and autonomously acts in response to conditions such as a kick or surge. Sensors in various combinations may monitor return fluid flow rate, fluid inflow rate, wellhead bore pressure, temperature of returning fluid, torque, rate of penetration and string weight change. The control system has corresponding control logic to monitor, warn and act based on the sensor inputs. The actions may include the warning of support personnel, closing an annular blowout preventer, shearing drill pipe using a ram shear, pumping heavier fluid down choke and kill lines, disconnecting the riser or various other actions.

Applicant believes that another reference corresponds to U.S. Pat. No. 9,031,823 B2 issued to Ranjan, et al. on May 12, 2015 for Systems and methods for subsurface oil recovery optimization. However, it differs from the present invention because Ranjan, et al. teach systems and methods for subsurface secondary and/or tertiary oil recovery optimization based on either a short term, medium term or long term optimization analysis of selected zones, wells, patterns/clusters and/or fields.

Applicant believes that another reference corresponds to U.S. Pat. No. 10,267,128 B2 issued to Parrella on Apr. 23, 2019 for Pulsing pressure waves enhancing oil and gas extraction in a reservoir. However, it differs from the present invention because Parrella teaches a method and system that conditions an underground reservoir to cause oil and gas to increase flow, excites the conditioned underground reservoir with pressure waves to further increase flow, and recovers the oil and gas with the increased flow. The excitation may be done via one or more production wells in synchronism with excitation done via one or more conditioning wells so as to cause constructive interference of the pressure waves and further increase flow.

Applicant believes that another reference corresponds to U.S. Pat. No. 10,443,364 B2 issued to Parrella, et al. on Oct. 15, 2019 for Comprehensive enhanced oil recovery system. However, it differs from the present invention because Parrella, et al. teach a comprehensive enhanced oil recovery system that combines a plurality of different implementations of several enhanced oil recovery methods in an integrated system. The enhanced oil recovery system includes heating an underground reservoir having a heat transfer matrix to increase the temperature of the reservoir around a production well. The heat transfer matrix includes thermal injection wells, production wells, and heat delivery wells.

Applicant believes that another reference corresponds to U.S. Pat. No. 10,451,190 B2 issued to Goehler, et al. on Oct. 22, 2019 for Pressure release valve for oil recovery systems. However, it differs from the present invention because Goehler, et al. teach a pressure release valve suitable for use as an oil recovery valve. In one embodiment, the pressure release valve may comprise a piston and tube configured to slide within a valve body, wherein the piston is configured to remain sealingly engaged with the tube until the pressure release valve fully activates. Upon activation, the piston may disengage from the tube, thereby allowing fluid to escape from the valve through the tube.

Applicant believes that another reference corresponds to U.S. Patent Application Publication No. 2017/0247993 A1, published on Aug. 31, 2017 to Perrella for Closed loop energy and power system to support enhanced oil recovery that is environmentally friendly. However, it differs from the present invention because Perrella teaches a method and apparatus for burning crude oil or natural gas extracted from an underground reservoir, or for burning both crude oil and natural gas extracted from an underground reservoir, for providing thermal energy. The method and apparatus are also shown transferring the thermal energy to brine separated from the extracted oil, gas or both, for providing heated brine, or for converting the thermal energy to mechanical work, or for both transferring the thermal energy to the separated brine and converting the thermal energy to mechanical work. The method and apparatus are also shown heating the underground reservoir with the heated brine injected into the underground reservoir, or heating the underground reservoir with a resistive cable energized by electricity generated by converting the mechanical work to electric energy, or heating the underground reservoir with both the heated brine and the energized resistive cable.

Applicant believes that another reference corresponds to U.S. Patent Application Publication No. 2019/0218889 A1, published on Jul. 18, 2019 to Cioanta, et al. for Shock waves for oil separation. However, it differs from the present invention because Cioanta, et al. teach a pressure shock wave apparatus that applies shock waves to separate substances, such as oil, from a water mixture in an enclosure. The substance, such as oil, is moved toward a substance removal conduit and the water moved toward a water conduit from action of the shock wave apparatus.

Applicant believes that another reference corresponds to International Application Publication No. WO 2014056949 A2, published on Aug. 12, 2015 to Morgensen et al. for Method and apparatus for enhanced oil recovery. However, it differs from the present invention because Morgensen et al. teach a method for the recovery of oil or other hydrocarbon deposits from a subterranean formation below a surficial formation, comprising the steps of: a] separating an air stream into an oxygen-rich stream and a nitrogen rich stream; b) pressurizing said nitrogen-rich stream and injecting the pressurized nitrogen stream into the subterranean formation; c) collecting hydrocarbons displaced by the injected fluid; d) combusting at least a portion of the collected hydrocarbons and generating a carbon dioxide-rich stream from the products of the combustion; and, e) pressurizing the carbon dioxide-rich stream and injecting the pressurized carbon dioxide stream into the subterranean formation, wherein in the method at least a portion of the oxygen-rich stream is used in step d).

Applicant believes that another reference corresponds to International Application Publication No. WO 2016057780

A1, published on Apr. 14, 2016 to Parrella, et al. for Comprehensive enhanced oil recovery system. However, it differs from the present invention because Parrella, et al. teach a comprehensive enhanced oil recovery system that combines a plurality of different implementations of several enhanced oil recovery methods in an integrated system that results in oil extraction rates and total recoverable oil that exceeds any individually implemented methods. The individual techniques of the enhanced oil recovery system create compounded recovery effects to improve oil and gas recovery in a reservoir.

Applicant believes that another reference corresponds to International Application Publication No. WO 2017091688 A1, published on Jun. 1, 2017 to Parrella, et al. for Reservoir modeling system for enhanced oil recovery. However, it differs from the present invention because Parrella, et al. teach a predictive modeling system for an enhanced oil recovery system to accurately model the temperature profiles in an oil reservoir of the enhanced oil recovery system in three dimensions over time, and accurately model the flow fields in three dimensions over time. The modeling system allows for intelligent adjustment of the injection well and thermal well inputs over time. The modeling system allows the user to manipulate the injection and production port profiles over time and manipulate the relative position of the production, thermal, and injection wells within the reservoir and model the heat from the production well flow on the near field volume can be accurately modeled.

Other patents describing the closest subject matter provide for a number of more or less complicated features that fail to solve the problem in an efficient and economical way. None of these patents suggest the novel features of the present invention.

SUMMARY OF THE INVENTION

The present invention is a pressure assisted oil recovery system and apparatus comprising a pulsating effect unit, a multiphasic flow meter, and a production lift system that passes through a wellbore up to an oil reservoir.

The pulsating effect unit comprises a unit housing. The unit housing comprises a solar panel at a top. The pulsating effect unit comprises a control valve, a pressure transmitter, a temperature transmitter, and a smart control unit. The unit housing houses the control valve, the pressure transmitter, the temperature transmitter, and the smart control unit.

The production lift system comprises production tubing and a wellhead. The pulsating effect unit is connected to the production lift system. The control valve is connected to the production tubing. The pressure transmitter and the temperature transmitter are connected to the production tubing. The multiphasic flow meter is connected to the production tubing to obtain well production parameters data including temperature, pressure, initial content of water, and initial content of oil. The multiphasic flow meter connects to the smart control unit. The multiphasic flow meter and the smart control unit comprise wired or wireless connection. The multiphasic flow meter provides the smart control unit, the well production parameters data including the temperature, the pressure, the initial content of water, and the initial content of oil.

The control valve opens and closes with a predetermined opening/closing frequency. When the control valve opens and closes, pressure variations along the production tubing are generated. The pressure variations create a pulsating effect on walls of the wellbore. The multiphasic flow meter and the pulsating effect unit set an optimal opening/closing frequency of the control valve. The multiphasic flow meter is removably connected to the production tubing, whereby the multiphasic flow meter is removed when the optimal opening/closing frequency of the control valve is determined.

The oil reservoir is an exploited oil reservoir, which comprises the initial content of water, and the initial content of oil. The pulsating effect allows that the oil reservoir gets a final content of water, and a final content of oil, whereby the final content of water is lesser than the initial content of water, and the final content of oil is greater than the initial content of oil.

It is therefore one of the main objects of the present invention to provide a pressure assisted oil recovery system and apparatus.

It is another object of this invention to provide a pressure assisted oil recovery system and apparatus that has a pulsating effect unit.

It is another object of this invention to provide a pressure assisted oil recovery system and apparatus having a multiphasic flow meter.

It is another object of this invention to provide a pressure assisted oil recovery system and apparatus, which generates a pulsating effect in walls of a wellbore.

It is another object of this invention to provide a pressure assisted oil recovery system and apparatus, which increases oil production in exploited oil reservoirs.

It is another object of this invention to provide a pressure assisted oil recovery apparatus, which is of a durable and reliable construction.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
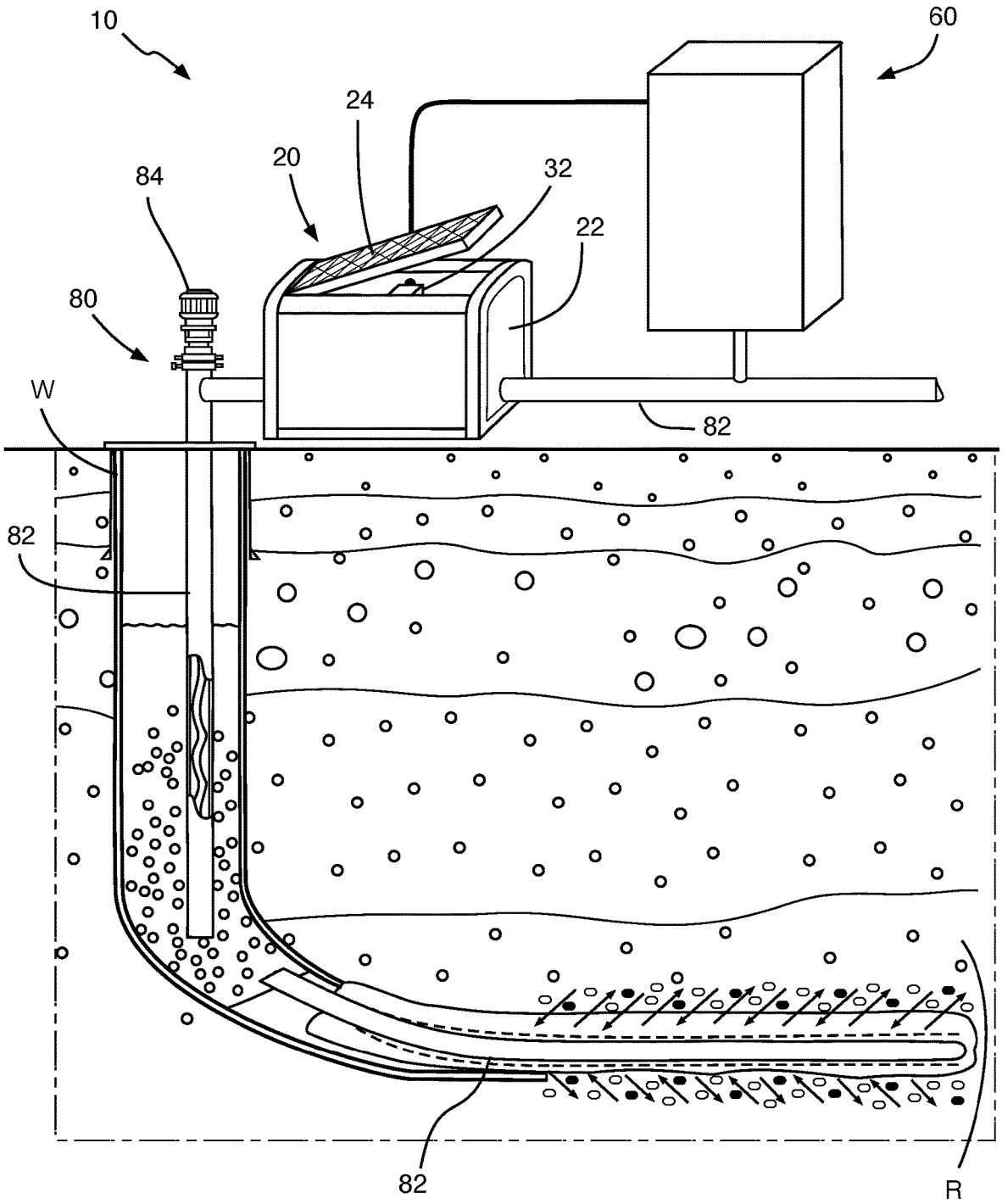
FIG. 1 represents a system of the present invention.

Referring now to the drawings, the present invention is a pressure assisted oil recovery system and apparatus, and is generally referred to with numeral 10. It can be observed that it basically includes pulsating effect unit 20, multiphasic flow meter 60, and production lift system 80.

As seen in FIG. 1, pulsating effect unit 20 and multiphasic flow meter 60 are connected to production lift system 80, whereby production lift system 80 passes through wellbore W up to oil reservoir R. Production lift system 80 comprises production tubing 82 and wellhead 84.

Figure 2:
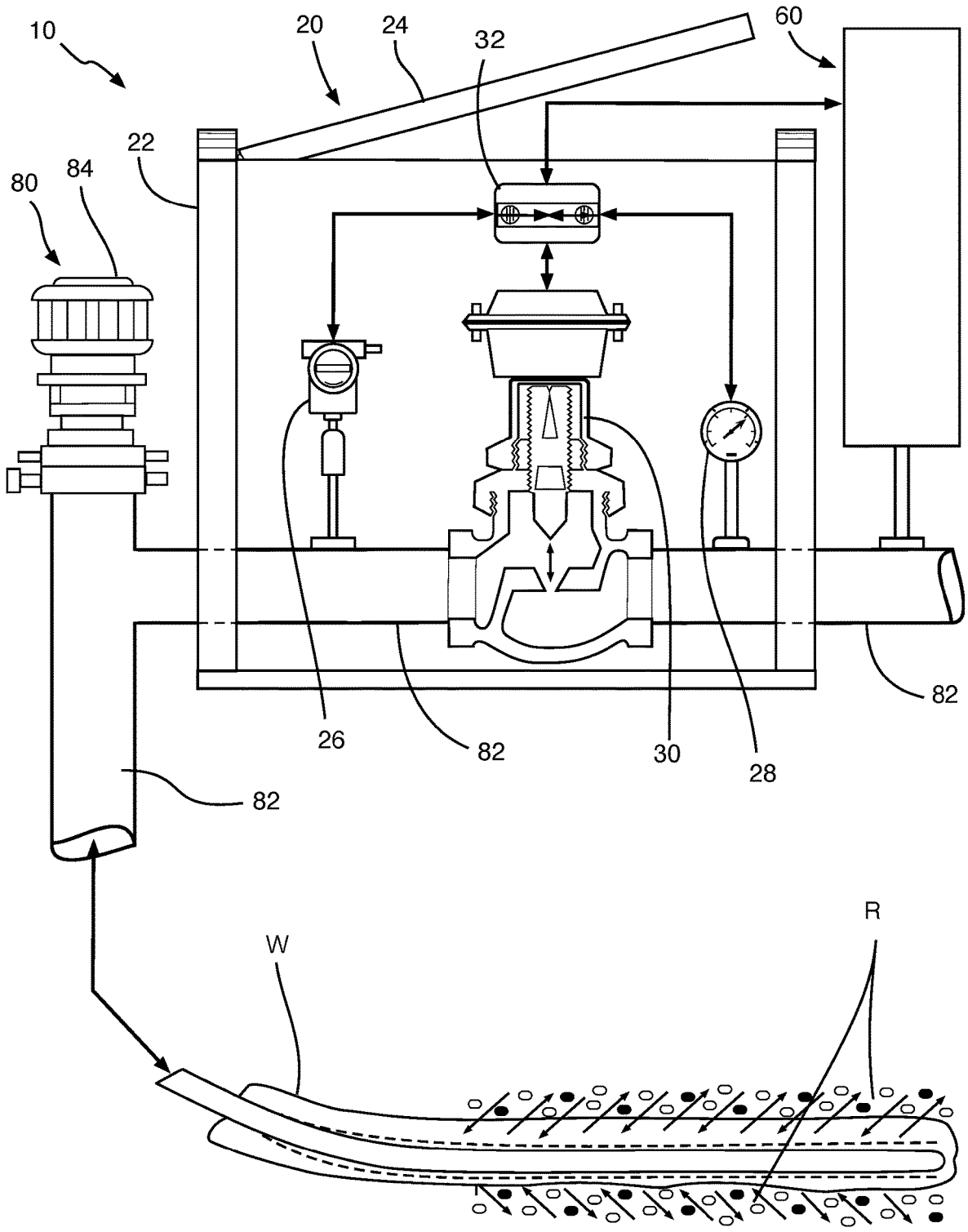
FIG. 2 is a front view of a pulsating effect unit as part of the system of the present invention.

As seen in FIG. 2, pulsating effect unit 20 comprises unit housing 22. Unit housing 22 comprises solar panel 24 at a top. Pulsating effect unit 20 also comprises control valve 30, pressure transmitter 26, temperature transmitter 28, and smart control unit 32. Unit housing 22 houses pressure transmitter 26, temperature transmitter 28, control valve 30, and smart control unit 32. Solar panel 24 provides energy to pulsating effect unit 20. Pressure transmitter 26 and temperature transmitter 28 are connected to control valve 30. Control valve 30 is connected to production tubing 82. Pressure transmitter 26 and temperature transmitter 28 are also connected to production tubing 82.

Multiphasic flow meter 60 is connected to production tubing 82 to obtain well production parameter data such as temperature, pressure, initial content of water, and initial content of oil. Pulsating effect unit 20 communicates with multiphasic flow meter 60. Specifically, multiphasic flow meter 60 connects to smart control unit 32. Multiphasic flow meter 60 and smart control unit comprise a wired or wireless connection. In a preferred embodiment, multiphasic flow meter 60 connects to smart control unit 32 through a "MODBUS" Ethernet protocol or other Ethernet protocol having a similar functionality. Multiphasic flow meter 60 provides smart control unit 32 well production parameters data including temperature, pressure, initial content of water, and initial content of oil.

Control valve 30 opens and closes having an opening/closing predetermined frequency. When control valve 30 opens and closes, it generates pressure variations along production tubing 82. The pressure variations create a pulsating effect on walls of wellbore W. The opening/closing frequency of control valve 30 is determined through multiphasic flow meter 60. Multiphasic flow meter 60 and smart control unit 32 establish an optimal opening/closing frequency of control valve 30 by which oil reservoir R increases oil production. Multiphasic flow meter 60 is removable connected to production tubing 82, whereby multiphasic flow meter 60 is removed when the optimal opening/closing frequency of control valve 30 is found. Optimal opening/closing frequency of control valve 30 is the frequency at which wellbore W increases the oil production, due to the pulsating effect created by pressure variations. Optimal opening/closing frequency of control valve 30 depends of the type of wellbore W and oil reservoir R.

Figure 3:
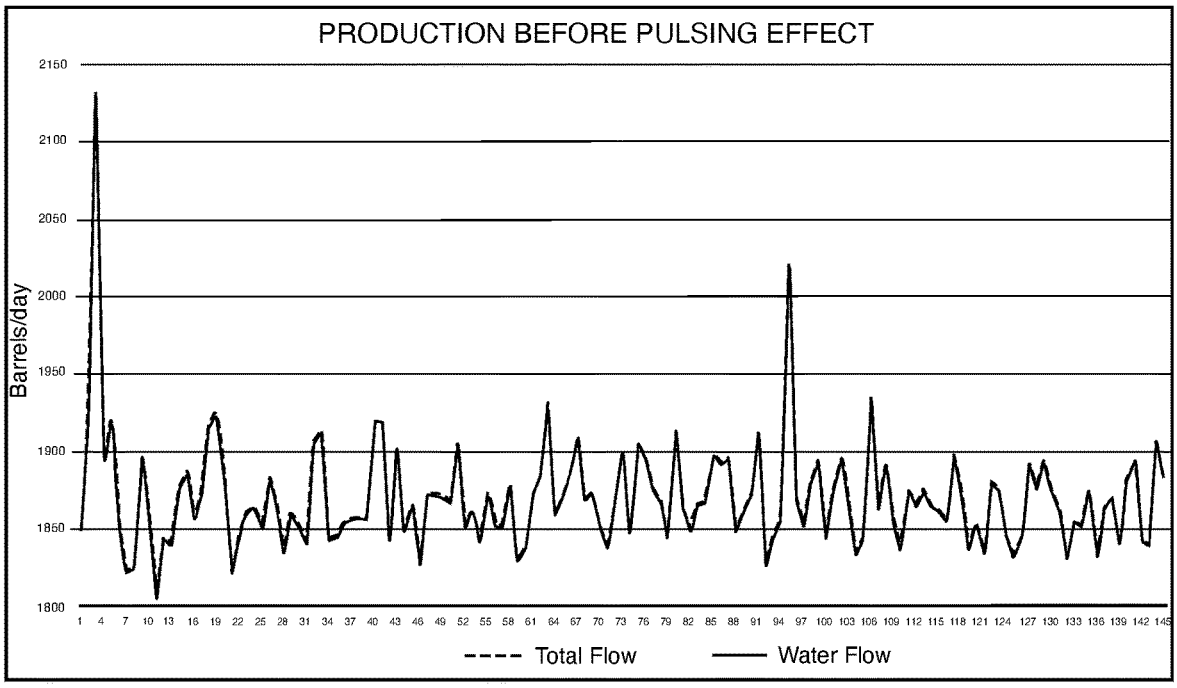
FIG. 3 is a graphic that represents an initial content of water and an initial content of oil in a wellbore.
Figure 4:
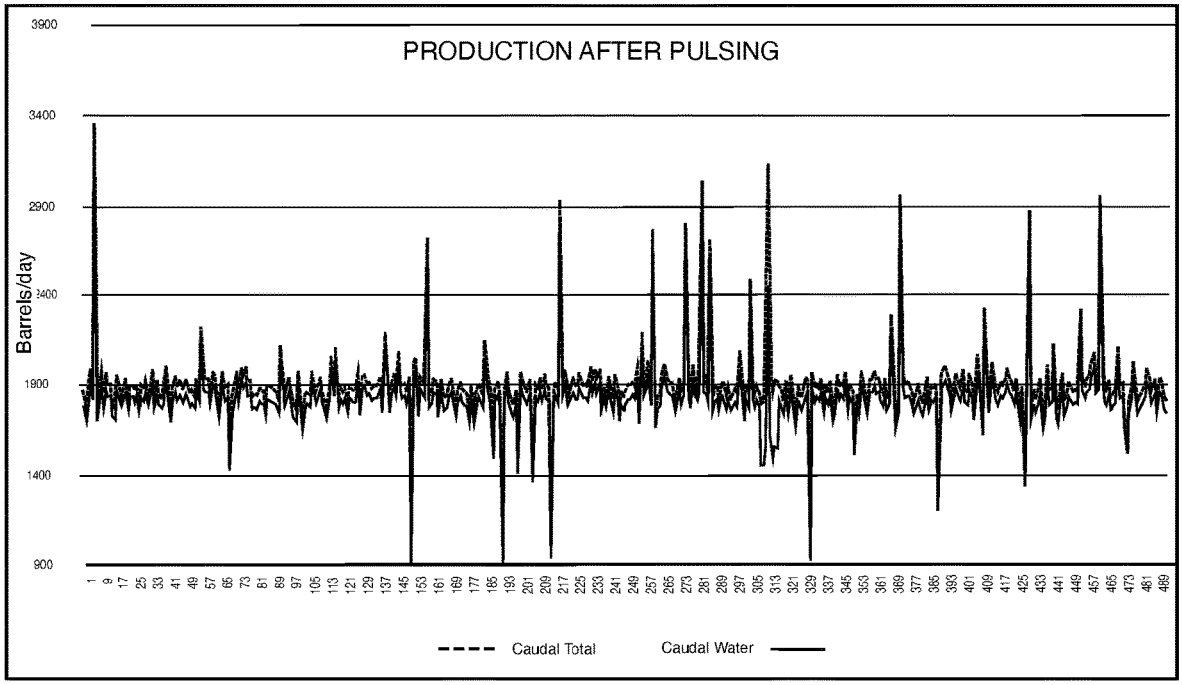
FIG. 4 is a graphic that represents the content of water and the content of oil in the wellbore after implementation and operation the present invention.
Figure 5:
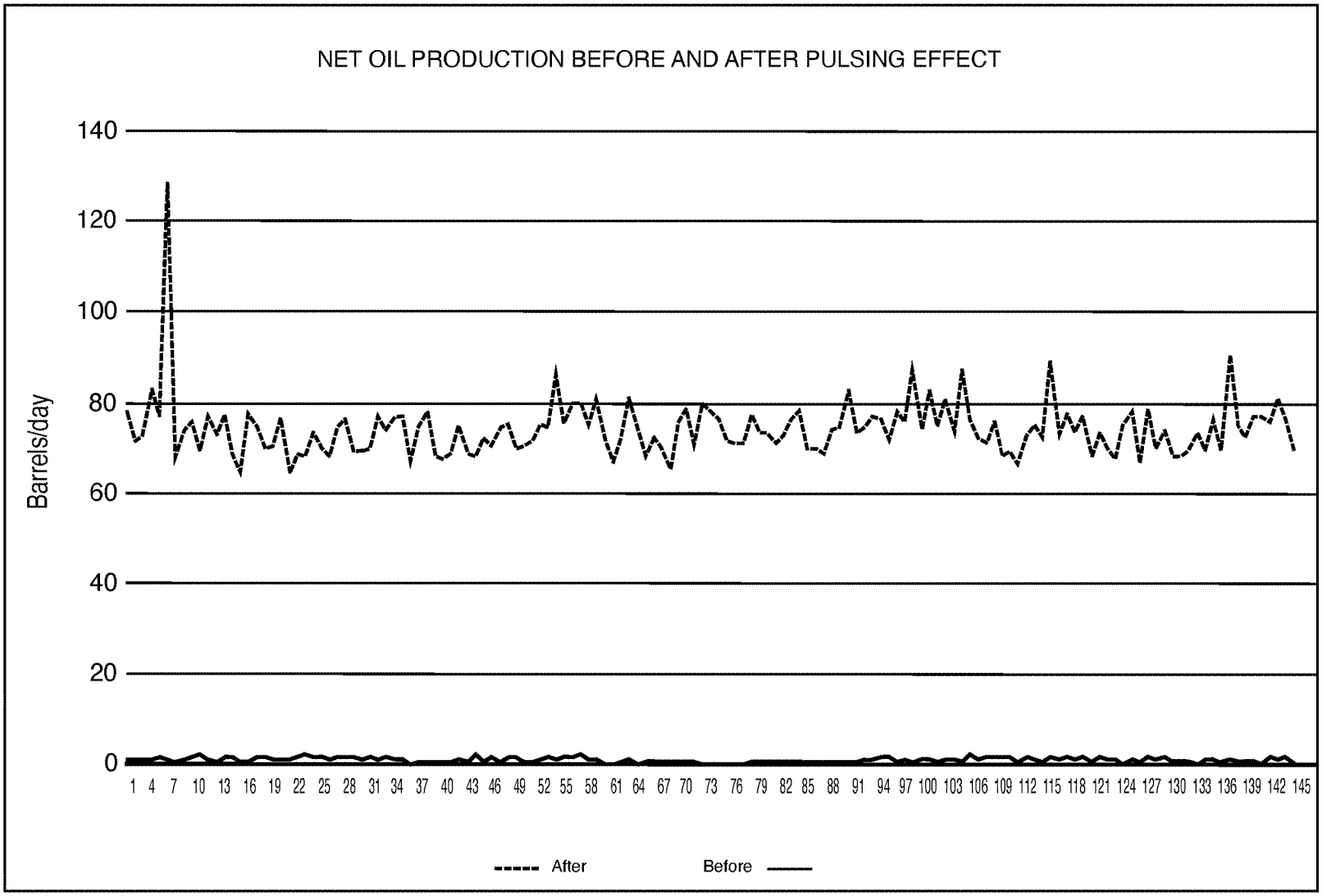
FIG. 5 is a graphic that represents oil production before and after pulsing effect of the present invention.

As seen in FIGS. 3, 4, and 5, oil reservoir R is an exploited oil reservoir R, which comprises the initial content of water, and the initial content of oil. The pulsating effect allows that oil reservoir R gets a final content of water, and a final content of oil, whereby the final content of water is lesser than the initial content water, and the final content of oil is greater than the initial content of oil. Usually, the initial content of oil is approximately zero.

The pulsating effect causes that the fraction of water and the fraction of oil changes in the rocks of oil reservoir R. The pulsating effect acts on capillary pressures in the rock of oil reservoir R and this causes fractional flows of oil and water to be modified, whereby the content of oil increases and content of water decreases.

Once optimal opening/closing frequency of control valve 30 is found, smart control unit 32, as seen in FIG. 2, keeps replicating that opening/closing frequency of control valve 30 and this effect is maintained over time while it is operating. If pulsating effect unit 20 is removed from production lift system 80, wellbore W returns to its initial production condition. Multiphasic flow meter 60 and smart control unit 32, both seen in FIG. 2, perform an automated search for the optimal point of production where wellbore W produces the largest volume of oil. The optimal opening/closing frequency is sought by generating various pulsating patterns at different pressures. Once the optimal pattern, wherein oil production increases is found, smart control unit 32 and multiphasic flow meter 60 initiate a pattern replication process by modifying the pressure in production lift system 80.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A pressure assisted oil recovery system and apparatus comprising:

A) a pulsating effect unit;

B) a multiphasic flow meter; and

C) a production lift system that passes through a wellbore to an oil reservoir, said production lift system comprises production tubing and a wellhead, said multiphasic flow meter is removably connected to said production tubing, whereby said multiphasic flow meter is removed when said optimal opening/closing frequency of said control valve is determined.

2. The pressure assisted oil recovery system and apparatus set forth in claim 1, further characterized in that said pulsating effect unit comprises a unit housing.

3. The pressure assisted oil recovery system and apparatus set forth in claim 2, further characterized in that said unit housing comprises a solar panel at a top.

4. The pressure assisted oil recovery system and apparatus set forth in claim 2, further characterized in that said pulsating effect unit comprises a control valve, a pressure transmitter, a temperature transmitter, and a smart control unit.

5. The pressure assisted oil recovery system and apparatus set forth in claim 4, further characterized in that said unit housing houses said control valve, said pressure transmitter, said temperature transmitter, and said smart control unit.

6. The pressure assisted oil recovery system and apparatus set forth in claim 4, further characterized in that said multiphasic flow meter connects to said smart control unit.

7. The pressure assisted oil recovery system and apparatus set forth in claim 4, further characterized in that said multiphasic flow meter and said smart control unit comprise wired or wireless connections.

8. The pressure assisted oil recovery system and apparatus set forth in claim 4, further characterized in that said control valve opens and closes with a predetermined opening/closing frequency.

9. The pressure assisted oil recovery system and apparatus set forth in claim 1, further characterized in that said pulsating effect unit is connected to said production lift system.

10. The pressure assisted oil recovery system and apparatus set forth in claim 1, further characterized in that said control valve is connected to said production tubing.

11. The pressure assisted oil recovery system and apparatus set forth in claim 1, further characterized in that said pressure transmitter and said temperature transmitter are connected to said production tubing.

12. The pressure assisted oil recovery system and apparatus set forth in claim 1, further characterized in that said multiphasic flow meter is connected to said production tubing to obtain well production parameters including temperature, pressure, initial content of water, and initial content of oil.

13. The pressure assisted oil recovery system and apparatus set forth in claim 12, further characterized in that said multiphasic flow meter provides said smart control unit, said well production parameters including said temperature, said pressure, said initial content of water, and said initial content of oil.

14. The pressure assisted oil recovery system and apparatus set forth in claim 12, further characterized in that when said control valve opens and closes, pressure variations along said production tubing are generated.

15. The pressure assisted oil recovery system and apparatus set forth in claim 14, further characterized in that said pressure variations create a pulsating effect on walls of said wellbore.

16. The pressure assisted oil recovery system and apparatus set forth in claim 15, further characterized in that said oil reservoir is an exploited oil reservoir, which comprises said initial content of water, and said initial content of oil.

17. The pressure assisted oil recovery system and apparatus set forth in claim 16, further characterized in that said pulsating effect allows that said oil reservoir gets a final content of water, and a final content of oil, whereby said final content of water is lesser than said initial content of water, and said final content of oil is greater than said initial content of oil.

18. The pressure assisted oil recovery system and apparatus set forth in claim 1, further characterized in that said multiphasic flow meter and said pulsating effect unit set an optimal opening/closing frequency of said control valve.

* * * * *